US005499431A

United States Patent [19]

Mortensen et al.

[11] Patent Number: 5,499,431

[45] Date of Patent: Mar. 19, 1996

[54] SPRING CLIP FOR HOLDING GARMENTS

[76] Inventors: Erik D. Mortensen, 20 Maple St., 329 Ramsey Hall, London, England, W1P 5GB; Donald W. Mortensen, 1215 Doctor's Dr., Neenah, Wis. 54956

[21] Appl. No.: 352,511

[22] Filed: Dec. 9, 1994

[51] Int. Cl.[6] ..... B65D 77/00; A44B 21/00

[52] U.S. Cl. ..... 24/543; 24/545; 24/552; 24/30.5 T; 24/DIG. 29

[58] Field of Search ..... 24/543, 545, 546, 24/547, 548, 552, 562, 30.5 T, 30.5 P, 30.5 S, 67.9, DIG. 29

[56] References Cited

U.S. PATENT DOCUMENTS

| | | | |
|---|---|---|---|
| 180,430 | 8/1976 | Lambert | 24/551 |
| 958,532 | 5/1910 | Pollock | 24/549 |
| 1,150,229 | 8/1915 | Schuch . | |
| 1,859,817 | 5/1932 | Dodd . | |
| 3,346,927 | 10/1967 | Tompkins | 24/245 |
| 3,357,070 | 12/1967 | Sloan | 24/255 |
| 3,673,639 | 7/1972 | Driscoll | 24/16 PB |
| 4,097,967 | 7/1978 | Conner, Jr. | 24/543 |
| 4,324,025 | 4/1982 | Apri | 24/261 R |
| 4,658,822 | 4/1987 | Kees, Jr. | 24/546 |
| 4,765,335 | 8/1988 | Schmidt et al. | 24/545 |
| 5,440,791 | 8/1995 | Guio | 24/543 |

*Primary Examiner*—Victor N. Sakran
*Attorney, Agent, or Firm*—Thomas D. Wilhelm

[57] ABSTRACT

This invention pertains to spring clip garment holders for holding garments, especially small garments such as pairs of socks, while the garments are being processed. In the rest position, the clip generally has a "U-shaped" configuration, including a bight and a pair of legs extending from the bight. The legs have upper sections extending toward each other, and lower sections extending away from each other, and the legs reside in surfaces which preferably intersect at an angle of no more than about 20 degrees. At least one of the legs includes a lock, such as a lock slot, for locking the legs together. In use, the spring clip garment holder is compressed, creating an opening for receiving a garment, and providing clearance for one leg to pass the other, thereby crossing one leg over the other. The compression is released after the garment is inserted into the opening, with the legs still crossed. Resilient restorative forces in the legs and bight urge the closing of the opening against the garment, thus holding the garment, and urge the facing surfaces of the legs against each other, thereby securing the locking of the legs together in the locks provided. The leg lock is thus engaged, providing secure holding of the garments while the garments are being processed.

36 Claims, 2 Drawing Sheets

SPRING CLIP FOR HOLDING GARMENTS

FIELD OF THE INVENTION

This invention relates to holding garments such as a pair of socks while the garments are being processed, as in conventional laundry equipment to prevent members of the pair from being separated while being e.g. laundered and dried.

BACKGROUND OF THE INVENTION

Socks are worn in pairs. When the socks are laundered or otherwise processed, the individual socks that constitute a pair can, and often do, become separated. Sometimes they become lost. At best, it is time-consuming to match up the individual socks from the several pairs which were washed. The potential for mismatching individual socks, and losing individual socks generally increases with the number of pairs being processed.

It is an object of this invention to provide an easily-used holder for holding a pair of socks in an opening by a perimeter line of compression about the socks while the socks are being laundered or otherwise processed.

It is another object to provide a single piece, spring-loaded socks holder.

It is still another object to provide such a holder having an operative lock on a leg, for locking the legs together when the opening holds a pair of socks.

It is yet another object to provide a holder having locking elements on both legs, and wherein the locking elements on the legs cooperate in locking the legs together, to thereby hold the socks in the opening.

It is further an object to provide a holder wherein the legs have cooperating lock slots, preferably with undercut ends on at least one of the lock slots, such that an outer surface on one of the legs engages an undercut end of the corresponding lock slot on the opposing leg.

Finally, it is an object to provide a hook on one of the legs, as a back-up lock mechanism to prevent uncrossing of the legs in the event the lock at the lock slots is breached before the user undertakes to disengage, and thus uncross, the legs, or otherwise enlarge the opening holding the socks.

SUMMARY OF THE DISCLOSURE

Some of the objects are obtained in a spring clip for holding one or more garments while the garments are being processed. The spring clip comprises a length of elongated material, such as a rod or wire, having resilient spring-like restorative properties such that the elongated material tolerates significant bending deformation without exceeding the corresponding elastic limit of the material. When the spring clip is in the rest position, the length of elongated material comprises first and second legs extending from a bight, the first and second legs having corresponding first and second upper sections, the upper sections extending toward each other and terminating in corresponding first and second elbows. The first leg has a first lower section extending from the first elbow. The second leg has a second lower section extending from the second elbow. The first and second lower sections extend away from each other, and when at rest, reside in corresponding first and second surfaces, which intersect at an angle of no more than about 20 degrees, with the lower section of the first leg comprising a lock for locking the first leg to the second leg.

It is preferred that the lock comprise a lock slot in the first lower section of the first leg, for-receiving and locking the first lower section of the first leg with the second lower section of the second leg.

It is also preferred that the lock slot have at least a first undercut end, preferably opposing first and second undercut ends, whereby, when the second leg is engaged in the lock slot of the first leg, a first undercut surface on an undercut end engages a second surface on the second leg.

In other embodiments, the first leg comprises a lower end, and the lock comprises a hook on the lower end of the first leg.

In some embodiments, the hook comprises a first lock, and the spring clip further includes, as a second lock, a lock slot in the first lower section of the first leg, for receiving the second lower section of the second leg, and locking the second lower section of the second leg to the first lower section of the first leg.

The spring clip can include one or more second leg lock slots on the lower section of the second leg, configured to cooperate with the lock slot and/or a hook on the first leg.

The second leg lock slot can comprise one or more undercut ends whereby, when the first leg is engaged in a corresponding one of the second leg lock slots, a first undercut surface on the corresponding one of the first undercut ends on the second leg lock slot engages a second surface on the first leg.

In some embodiments, the lock slots on both first and second legs have undercut ends whereby, when the lock slot on the first leg is engaged in a corresponding one of the second leg lock slots, an outer surface on one of the first and second legs engages an undercut surface on a the lock slot on the other of the first and second legs.

With the spring clip in the rest position, the lock slots on either leg typically face away from the second lower section of the opposing leg.

The invention further comprehends a method of holding one or more garments in a spring clip garment holder while the garments are being processed. The spring clip garment holder includes a length of elongated material having resilient spring-like restorative properties such that the elongated material tolerates significant bending deformation without exceeding the corresponding elastic limit of the material. When the spring clip is in the rest position, the length of elongated material comprises first and second legs extending from a bight, the first and second legs having corresponding first and second upper sections, the upper sections extending toward each other and terminating in corresponding first and second elbows. The first leg has a first lower section extending from the first elbow and terminating at a first end. The second leg has a second lower section extending from the second elbow and terminating at a second end. The first and second lower sections extend away from each other, and when at rest, reside in corresponding first and second surfaces which intersect at an angle of no more than about 20 degrees. The first lower section of the first leg comprises a lock for locking the first leg to the second leg.

Given the instantly above recited structure, the method of the invention comprises compressing the spring clip garment holder such that one of the first and second leg ends can pass the other leg, and whereby the first and second elbows move away from each other, creating an opening for receiving a garment thereinto; placing a garment in the Opening created at the elbows; passing the respective leg end past the corresponding other of the first and second legs such that the lower first and second sections of the legs are crossed;

releasing the first and second legs while the first and second lower sections are crossed such that restorative forces in the legs urge the legs back toward their rest position in the legs-crossed configuration, whereby the legs grip and hold the garment; and bringing the lock on the first leg into locking engagement with the second leg.

The method preferably includes engaging the second leg in a lock slot in the first leg such that a first undercut surface on the undercut end in the lock slot engages a second surface on the second leg.

As an alternative, the method comprehends engaging the second leg in a hook at the end of the first leg, and thereby temporarily locking the second leg to the first leg.

In some embodiments, the method comprehends using, as a first lock, a lock slot for receiving and locking the first lower section of the first leg with the second lower section of the second leg, the first leg having a lower end, and including, as a second lock, a hook on the lower end of the first leg, and including the step of aligning the lower section of the second leg with the hook in the first leg, such that the lower section of the second leg is simultaneously both locked into the lock slot and aligned with, and subject to being restrained by, the hook.

The invention still further comprehends using, as a first lock, a first lock slot for receiving and locking the first lower section of the first leg with the second lower section of the second leg, and including at least one second lock-slot on the second lower section of the second leg, the first and second lock slots facing away from each other, such that when the legs are crossed, the first and second lock slots face toward each other, and including the step of bringing the first and second lock slots into locking engagement with each other, preferably with an outer surface on one of the first and second legs engaging the corresponding undercut surface on the other of the first and second legs.

DETAILED DESCRIPTION OF THE ILLUSTRATED EMBODIMENTS

Figure 1:
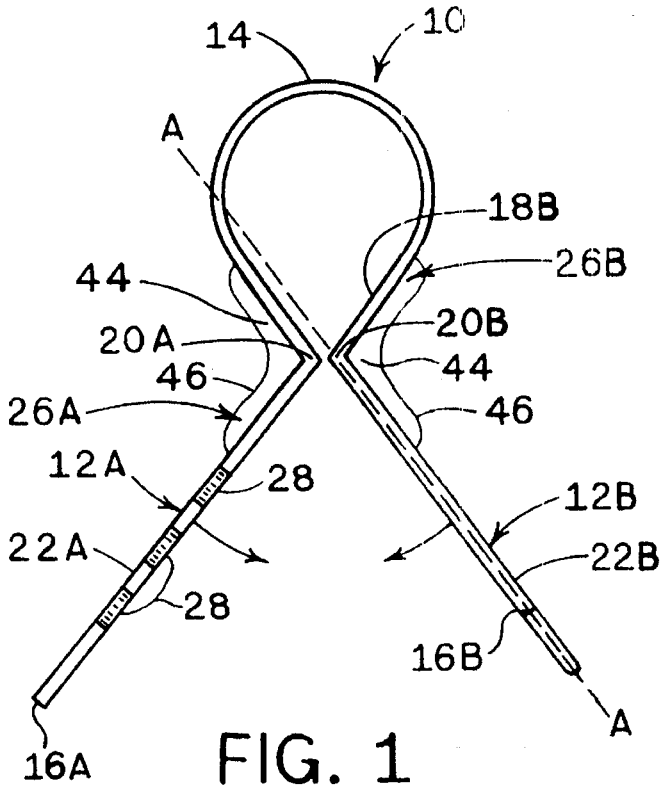
FIG. 1 shows a front elevation view of a spring clip of the invention.
Figure 2:
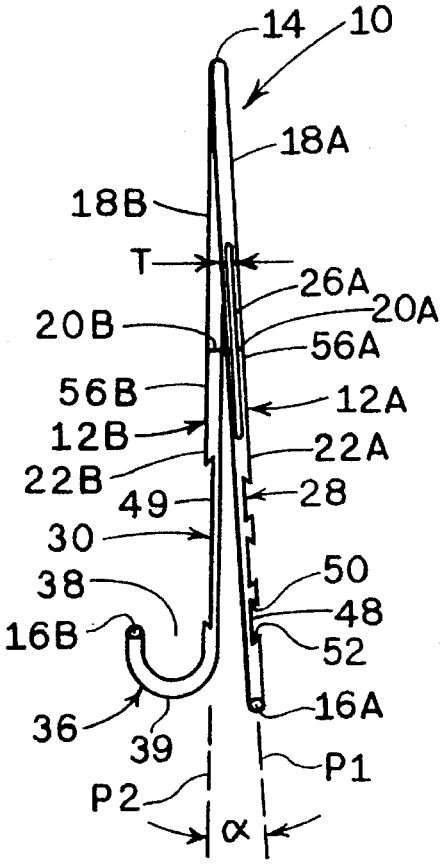
FIG. 2 shows a side elevation of the spring clip of FIG. 1.

Referring to the drawings, FIGS. 1 and 2 illustrate one embodiment of the spring clip for socks, in its relaxed, or rest, state. As seen therein, the spring clip 10 embodies a pair of opposing left and right legs 12A and 12B extending from a primary bight 14, to respective distal ends 16A and 16B of the legs.

The legs 12A and 12B have upper sections 18A and 18B, wherein the legs 12A and 12B extend toward each other. The upper sections 18A and 18B terminate in respective elbows 20A and 20B in the respective legs. Legs 12A and 12B further have lower sections 22A and 22B extending from the respective elbows 20A and 20B to the distal ends 16A and 16B.

Flanges 26A and 26B extend outwardly of the legs along upper and lower sections 18 and 22 of the respective legs 12A and 12B adjacent, and on both sides of, elbows 20A and 20B.

As illustrated, leg 12A includes a plurality of lock slots 28 along the length of its lower section 22A. Three lock slots 28 are illustrated. A lesser or greater number of lock slots 28 may be used as desired for the particular application contemplated.

As seen in FIG. 2, lock slots 28 face in a direction disposed generally away from leg 12B. Leg 12B includes a single elongated lock slot 30 extending along the length of its lower section 22B. As seen in FIG. 2, lock slot 30 faces in a direction disposed generally away from leg 12A.

The bight and legs of the spring clip 10 are preferably fabricated from a single length of elongated material such as a rod or wire, typically of circular or elliptical cross-section. The shape of the cross-section, however, is not critical, as suitable adaptations for a wide variety of cross-sections of elongated materials can be made within the scope of the invention. Suitable materials can be selected from, for example, plastic-coated metal, plastic rod wherein the entire cross-section of the rod is polymeric, and other natural or man-made materials which can withstand the normal laundry environment, especially the typical operating temperatures, while retaining the corresponding elastic memory. As polymeric materials, there can be mentioned, for example, nylon, especially nylon 6, and in some applications polyester, for example polyethylene terephthalate.

There are three critical properties of the material from which the upper sections 18A, B, of the legs and bight 14, and preferably elbows 20A, B, and lower sections 22, A, B of the spring clip are made. First, the material must withstand the typical elevated temperatures of washing and drying laundry equipment, preferably for an indefinite number of cycles.

Second, the material cannot be so harsh as to damage the laundry equipment.

Third, the material must retain its restorative elastic memory throughout the laundry processing cycle, preferably for an indefinite number of processing cycles.

Where, as typical, the legs and bight are made from a single piece of material, the entire length of both legs and the bight will possess the restorative elastic memory. However, operation of the spring clip 10 does not necessarily require compression/bending of the lower sections 22A, B, of the legs. Rather, the operative restorative forces used to close the opening 34 are encompassed primarily in primary bight 14, and to a lesser degree in upper sections 18A, B, of the legs 12. Accordingly, the lower sections 22A, B, can in principle operate satisfactorily without contributing significantly to the restorative forces which close opening 34 about the socks 40.

Figure 4:
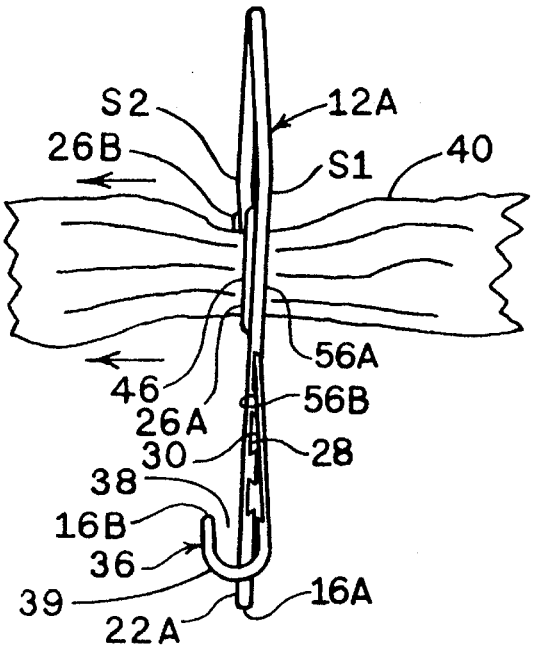
FIG. 4 shows a side elevation of the spring clip of FIG. 3 holding the garment.

Referring to FIGS. 2 and 4, leg 20B includes, at its lower distal end 16B an up-turned hook 36 extending in a direction away from leg 12A and away from the lock slots 28 of leg 12A, with both the hook 36 and leg 12B being generally included in a plane defined by the dashed line A—A in FIG. 1. Hook 36 includes an opening 38 defined about secondary bight 39 between the primary portion of the lower section 22B of the leg and the up-turned distal end 16B, the opening 38 being large enough to receive the shaft of the corresponding portion of the lower end 22A of leg 12A. See FIG. 4. Correspondingly, in order for the legs to cooperate in hook 36, operating as either a primary lock, or as a back-up lock in support of a lock slot 28, the lower section 22A of leg 12A must extend far enough downwardly past hook 36, as seen in FIG. 4, to enable interference between leg 12A and hook 36 at the bight 39, whereby the hook operates as a back-up lock mechanism to prevent inadvertent uncrossing of the legs and corresponding release of the socks 40 or other garment being held due to, for example, mechanical or fluid forces encountered during washing or drying of the socks in conventional laundry equipment.

Figure 3:
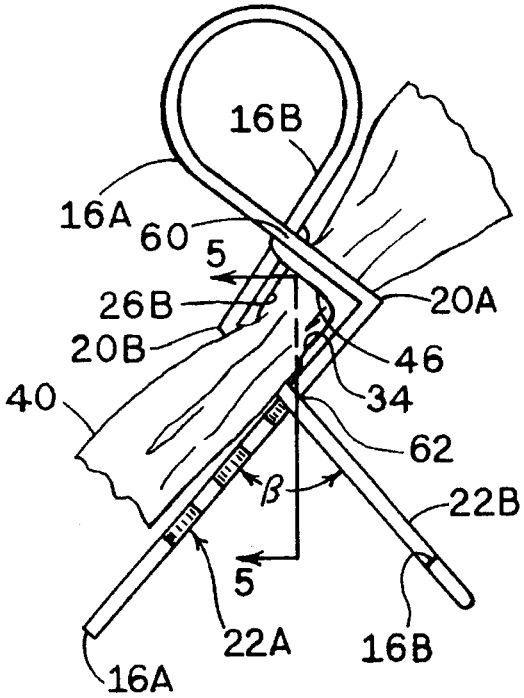
FIG. 3 shows a front elevation view of a spring clip of the invention with the legs crossed, and with the spring clip holding a garment in the garment-holding opening.
Figure 6:
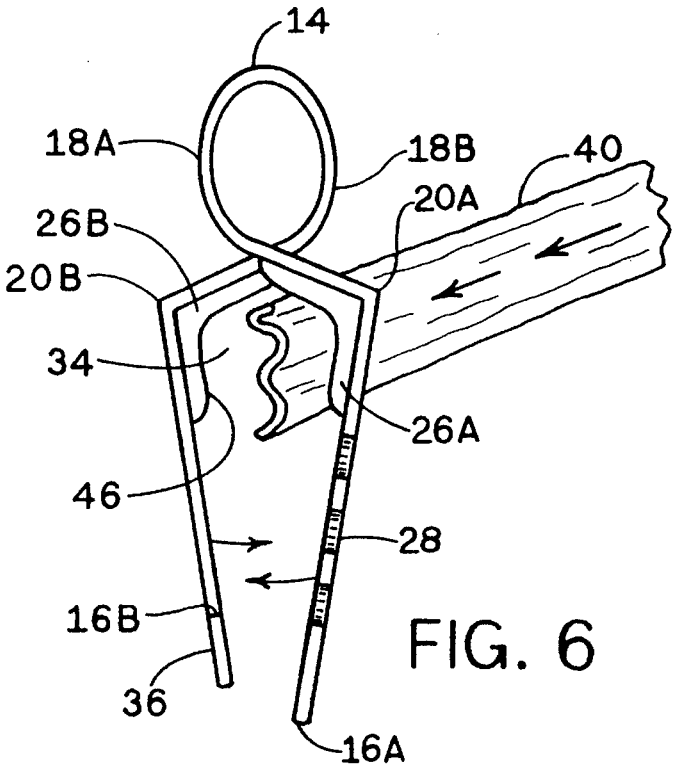
FIG. 6 shows an elevation view as in FIG. 1 with the spring compressed, ready to receive a pair of socks or other garment to be held, and wherein the ends of the legs are disposed past each other such that the legs can be crossed without further compression against the restorative forces of the spring-clip material.

Referring to FIGS. 1, 3, and 6, the elbows 20 are critical to the holding function of the holder 10. As seen in FIG. 6, when the distal ends 16A and. 16B of the legs are brought together and/or past each other, the elbows, in combination with adjacent portions of the upper and lower leg sections, define the opening 34 through which the socks 40 or other garments extend while being held in the spring clip. Thus, the configuration of the legs at, and adjacent, the elbows should be such as to facilitate creating and enlarging opening 34 when the legs are brought together as in FIG. 6, and closing about the garments when the legs are released for holding the garments, as shown in FIG. 3. Accordingly, the upper and lower sections 18 and 22 of the legs 12 should extend from elbows 20 at an initial included angle, between the upper and lower sections 18 and 22, of from about 75 degrees to about 135 degrees, preferably about 90 degrees to about 120 degrees. The preferred angle shown is approximately 105 degrees. The particular configuration of the upper and lower sections of the legs 12 adjacent elbows is not critical so long as the overall combination of the two sets of the respective upper section, the respective lower section, and the respective elbow cooperate to create the opening 34 when the spring clip 10 is compressed as in FIG. 6.

As seen in FIG. 2, when the spring clip 10 is at rest, legs 12A and 12B reside in corresponding planes "P1" and "P2" which intersect at an angle $\alpha$ of no more than about 20 degrees, but preferably at least 5 degrees. The angle shown is about 10 degrees. When the legs are crossed, the angle $\alpha$ is closed in bringing the lower sections of the legs into and past alignment with each other for crossing.

The resilient restorative forces inherent in the material used for the spring clip 10 resist the closure of angle $\alpha$ and thereby exert biasing forces on the crossed legs, urging the lower sections 22A, 22B of the legs toward each other. Thus the closure of angle $\alpha$ exerts a constant restorative biasing force urging the lock slot 30 into contact with a corresponding one of the lock slots 28; and urges the lock slots in corresponding cooperating directions such that the restorative force urges the floor 48 of a lock slot 28 into engagement with the corresponding floor 49 of lock slot 30, whereby the lock slots 28, 30 are urged into locking relationship with each other.

The magnitude of the restorative forces urging the legs, and thus the lock slots into engagement with each other when the legs are crossed, is a function of the magnitude of the deflection of the legs in closing the angle $\alpha$ as the legs are crossed. The larger the angle $\alpha$ the greater the restorative forces urging the lock slots into engagement with each other. Thus, to a degree, a larger angle $\alpha$ is preferred. However, the larger the angle $\alpha$, the greater the relative distance that the legs must be moved out of the planes "P1" and "P2" in crossing the legs, along with corresponding increases in manual dexterity needed to so manipulate the legs. Thus, an angle $\alpha$ of at least 5 degrees is preferred in order to generate meaningful forces urging the lock slots 28, 30 together; while the angle should be limited to no more than 20 degrees in order that requirements for manual dexterity in crossing the legs not be overly burdensome. The angle $\alpha$ can be less than 5 degrees given a high enough elastic modulus for the material used to make the spring clip. Similarly, the angle $\alpha$ can be greater than 20 degrees so long as the required manipulative dexterity for crossing the legs is provided.

Flanges 26A and 26B are secured to the legs on those portions of the surfaces of the legs which face away from each other at elbows 20 and which are adjacent elbows 20 on the upper and lower sections 18 and 22 of the legs, as shown in FIG. 1. A comparison of FIGS. 1, 3, and 6 illustrates that opening 34 is created, and that the flanges are disposed in the inner perimeter of opening 34, when the spring 10 is compressed by bringing the legs 12 together and past each other, and thus crossing the legs, as will be further illustrated hereinafter.

The flanges 26 are deflected by the garment as the garment is inserted longitudinally into opening 34 and pushes against the flanges. See the arrows in FIGS. 4 and 6, and the deflected flanges 26 in FIG. 4. The flanges 26 provide additional holding surfaces in contact with the garment, and thus provide increased holding power of the spring clip holder 10 for a given level of compressive stress as exerted on the socks 40, by the holder.

As seen in, for example, FIG. 2, the flanges 26 have a thickness "T" that is relatively thinner than the general cross-section of the legs 12, so that the flange material is flexible enough that it can deflect along the direction of movement of the garment as the garment is inserted into the opening 34, and thus apply, against the garment, a major portion of the surface area 44 of the corresponding flange, surface area 44 extending from the intersection of the respective flange 26 with the respective leg 12, to the outer edge 46 of the corresponding flange. Such deflections are illustrated in FIGS. 3 and 4.

Figure 5:
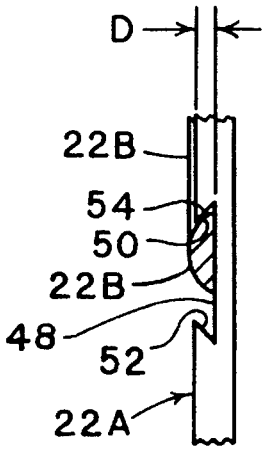
FIG. 5 shows an enlarged fragmentary section taken at 5–5 of FIG. 3, highlighting the locking feature.

Lock slots 28 extend along the lower section of leg 12A. Each lock slot preferably includes a floor 48, and upper and lower undercut surfaces 50 and 52 respectively connecting the floor 48 to the outer surface of the respective leg. Any given lock slot must be long enough to receive the opposing leg 12B therethrough at the effective angle $\beta$ between the legs 12A and 12B when the restorative forces in the spring clip are-actually holding the socks 40 in the opening 34. The lock slot should be deep enough (dimension "D") to securely receive and hold the corresponding element of lower portion 22B of leg 12B. As indicated in FIG. 5, it is preferred that an outer surface 54 of the leg 12B engage one of the undercut surfaces 50, 52 of the lock slot, in order to ensure secure engagement of the locking mechanism.

As used herein, "surface engagement" of the undercut surface 48 or 50 requires more than touching of the edge of the corresponding surface 48 or 50 at a point on the line of intersection between the corresponding undercut surface with an outer surface of the leg outside the lock slot. Rather, "surface engagement" as used herein means actual surface-to-surface engagement inside the boundaries of surfaces 48 and 50 defined by the lines of intersection between surfaces 48 and 50 and the corresponding outer surface of the leg.

It is preferred that the portion of leg 12B engaging the lock slot 28 be within the length of leg 12B which includes lock slot 30, whereby the combined reduced thicknesses of the cross-sections of legs 12A and 12B at the combined lock slots 28 and 30 are approximately equal to, and preferably no more than about 150% as great as, the thickness of the cross-section of one of the legs alone outside the lock slots. The illustration in FIG. 5 shows the combined thickness of the lock slots 28 and 30 as slightly greater than the thickness of leg 12A outside the lock slot 28. Combined thicknesses somewhat less than the thickness of the legs outside the lock slots are acceptable, but with increasing risk of insufficient strength in the legs at the slot areas as the thickness is reduced.

The lock slots 28 and 30 face away from each other in the relaxed state seen in FIG. 2. After the spring clip 10 is compressed as seen in FIG. 6, and the legs are crossed as seen in FIGS. 3 and 4, the lock slots 28 and 30 are thereby brought into facing relationship with each other., whereby the legs can be locked together using the lock slots.

It is contemplated that the operation and functions of the invention have become fully apparent from the foregoing description of elements, but for completeness of disclosure the usage of the invention will be briefly described.

Starting with the spring clip 10 in its relaxed state as shown in FIGS. 1 and 2, and referring especially to FIGS. 3, 4, and 6, the spring clip of the invention is used by first compressing the spring, and thus bringing the leg ends 16A and 16B together as shown by the arrows in FIG. 1, creating opening 34, and such that the leg ends 16A and 16B can pass each other as shown in FIG. 6. With the spring so compressed, the legs are crossed, with, in the embodiment as illustrated, the distal end 20A of leg 12A passing behind the lower section 22B of leg 12B and thus closing the angle α. The compression is then released, whereupon restorative forces of the spring clip material (1) urge the distal ends of the legs away from each other, with corresponding closure or partial closure of opening 34 and (2) urge the facing surfaces 56A, 56B of the legs into contact with each other. The result is the configuration shown in FIG. 3, (also illustrated in FIG. 4) wherein the upper section 16A of leg 12A crosses in front of the upper section 16B of leg 12B at upper crossing locus 60, while the lower section 22B of leg 12B crosses in front of the lower section 22A of leg 12A at lower crossing locus 62. Accordingly, the legs cross between the upper sections and the lower sections. Such crossing of the legs is critical to the locking features incorporated into the instant invention. The exact positions of upper crossing locus 60 and lower crossing locus 62 shift about as the ends 16 of legs 12A and 12B move closer together or farther apart.

The socks or other garment to be held are introduced into opening 34, generally by a movement of the garment through the opening from a first side "S1" of the spring clip to a second opposing side "S2" of the spring clip. See FIG. 4. The socks 40 can be introduced either while the legs are being crossed as shown in FIG. 6, or after the legs are crossed but while the spring clip is again compressed by bringing the ends 16A, 16B of the legs closer together and thus expanding the opening 34 to receive the garment. In either case, with the garment disposed within the opening 34, the legs are again released, releasing the restorative powers of the resilient material of the clip in the bight and upper sections 18 of legs 12, whereby the distal ends 16A, 16B of the legs move away from each other while the opening 34 closes about the garment, securely holding the socks 40 or other garment in the opening 34, substantially above the lower locus 62 and below the upper locus 60. While minor portions of the garment can extend between the legs outside the opening 34, e.g. at upper or lower crossing loci 60, 62, so holding the garment is not preferred because the effectiveness of the respective locks 28 is thereby reduced.

When it is desired to remove the socks from the opening 34 the spring is compressed by bringing the ends 16A, 16B of the legs closer together, thereby expanding opening 34 and releasing the socks. In the alternative, the socks can, with somewhat greater stress on the socks, simply be pulled longitudinally out of the opening without compressing the spring clip to expand opening 34. When socks are again to be placed in the opening, the ends 16 of the legs 12 are brought together enough to expand the opening sufficiently for inserting the socks, whereupon the legs are released and the opening closes about the socks. Thus, once the legs are initially crossed, there is normally no need to uncross the legs to thereby return the spring clip 10 to its fully relaxed condition, as seen in FIGS. 1 and 2.

While the embodiment illustrated shows one leg 12A with multiple lock slots 28 and the other leg 12B with a single lock slot 30 having a length substantially longer than the length of lock slot 28, the invention contemplates that both legs could have single elongated lock slots as at 30, or that both legs could have multiple (shorter) lock slots as at 28.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A spring clip for holding one or more garments while the garments are being processed, said spring clip comprising a length of elongated material having resilient spring-like restorative properties such that the elongated material tolerates significant bending deformation without exceeding the corresponding elastic limit of the material, said length of elongated material comprising, when said spring clip is in a fully relaxed configuration, a bight, first and second legs extending from the bight, said first leg having a first upper section, said second leg having a second upper section, said first and second upper sections extending toward each other and terminating in corresponding first and second elbows, said first leg having a first lower section extending from said first elbow, said second leg having a second lower section extending from said second elbow, said first and second lower sections extending away from each other and terminating at first and second leg ends, said first and second legs being configured such that said first and second leg ends can be brought together whereby said first and second lower sections can be crossed, thereby creating an opening between said first and second elbows, an upper crossing locus wherein said first leg is in front of said second leg and a lower crossing locus wherein said second leg is in front of said first leg, edges of said opening being effective for gripping the garments substantially within said opening, said spring clip including a bias on said first and second legs when said legs are so crossed, urging facing surfaces of said first and second legs into engagement with each other, said first lower section of said first leg comprising a lock, said lock comprising a step irregularity in the cross-section of said second lower section, the bias in combination with the irregularity being effective to engage said second lower section of said leg and to lock said second lower section to said first lower section.

2. A spring clip as in claim 1, said lock comprising a lock slot in said first lower section of said first leg, for receiving and locking said first lower section of said first leg with said second lower section of said second leg.

3. A spring clip as in claim 2, and including at least one second leg lock slot on said second lower section of said second leg, configured to cooperate with said lock in said first leg.

4. A spring clip as in claim 3, said at least one second leg lock slot comprising a first undercut end whereby, when said first leg is engaged in a corresponding one of said second leg lock slots, a first undercut surface on the corresponding one of said first undercut ends on said second leg lock slot engages a second surface on said first leg.

5. A spring clip as in claim 4, and wherein, when said spring clip is in a fully relaxed configuration, said lock slot in said lower first section of said first leg faces away from said second lower section of said second leg and said at least one lock slot on said second lower section of said second leg faces way from said first lower section of said first leg.

6. A spring clip as in claim 3, and wherein, when said spring clip is in a fully relaxed configuration, said lock slot in said lower first section of said first leg faces away from said second lower section of said second leg and said at least one lock slot on said second lower section of said second leg faces away from said first lower section of said first leg.

7. A spring clip as in claim 2, said lock slot facing away from said second lower section of said second leg, when said spring clip is in a fully relaxed configuration.

8. A spring clip as in claim 7 said first and second lower sections of said first and second legs being disposed in corresponding first and second intersecting surfaces, said surfaces intersecting at an angle of no more than about 20 degrees.

9. A spring clip as in claim 2, said first and second lower sections of said first and second legs being disposed in corresponding first and second intersecting surfaces, said surfaces intersecting at an angle of no more than about 20 degrees.

10. A spring clip as in claim 2 wherein, when said legs are crossed, with the bias urging facing surfaces of said legs into engagement, with said ends of said legs released, and with said upper and lower crossing loci defining the opening, said lower crossing locus is disposed at said lock slot.

11. A spring clip as in claim 2, said lock slot comprising at least a first undercut end whereby, when said second leg is engaged in said lock slot, a first undercut surface on said first undercut end engages a second surface on said second leg.

12. A spring clip as in claim 11, and including at least one second leg lock slot on said second lower section of said second leg, configured to cooperate with said lock in said first leg.

13. A spring clip as in claim 12 and including a plurality of second leg lock slots on said second lower section of said second leg, configured to cooperate with said first and second locks on said first leg.

14. A spring clip as in claim 13, and wherein, when said spring clip is in a fully relaxed configuration, said lock slot in said lower first section of said first leg faces away from said second lower section of said second leg and said at least one lock slot on said second lower section of said second leg faces away from said first lower section of said first leg.

15. A spring clip as in claim 1, said at least one second leg lock slot comprising a first undercut end whereby, when said lock slot on said first leg is engaged in a corresponding one of said second leg lock slots, an outer surface on one of said first and second legs engages an undercut surface on a said lock slot on the other of said first and second legs.

16. A spring clip as in claim 15, and wherein, when said spring clip is in a fully relaxed configuration, said lock slot in said lower first section of said first leg faces away from said second lower section of said second leg and said at least one lock slot on said second lower section of said second leg faces away from said first lower section of said first leg.

17. A spring clip as in claim 11, said lock slot facing away from said second lower section of said second leg, when said spring clip is in a fully relaxed configuration.

18. A spring clip as in claim 12, and wherein, when said spring clip is in a fully relaxed configuration, said lock slot in said lower first section of said first leg faces away from said second lower section of said second leg and said at least one lock slot on said second lower section of said second leg faces away from said first lower section of said first leg.

19. A spring clip as in claim 1, and including at least one second leg lock slot on said second lower section of said second leg, configured to cooperate with said lock in said first leg.

20. A spring clip as in claim 19 said at least one second leg lock slot comprising a first undercut end whereby, when said first leg is engaged in a corresponding one of said second leg lock slots, a first undercut surface on the corresponding one said first undercut ends on said second leg lock slot engages a second surface on said first leg.

21. A spring clip as in claim 20, and wherein, when said spring clip is in a fully relaxed configuration, said lock slot in said lower first section of said first leg faces away from said second lower section of said second leg and said at least one lock slot on said second lower section of said second leg faces away from said first lower section of said first leg.

22. A spring clip as in claim 19, and wherein, when said spring clip is in a fully relaxed configuration, said lock slot in said lower first section of said first leg faces away from said second lower section of said second leg and said at least one lock slot on said second lower section of said second leg faces away from said first lower section of said first leg.

23. A spring clip for holding one or more garments while the garments are being processed, said spring clip comprising a length of elongated material having resilient spring-like restorative properties such that the elongated material tolerates significant bending deformation without exceeding the corresponding elastic limit of the material, said length of elongated material comprising, when said spring clip is in a fully relaxed configuration, a bight, first and second legs extending from the bight, said first leg having a first upper section, said second leg having a second upper section, said first and second upper sections extending toward each other and terminating in corresponding first and second elbows, said first leg having a first lower section extending from said first elbow, said second leg having a second lower section extending from said second elbow, said first and second lower sections extending away from each other and terminating at first and second leg ends, said first and second legs being configured such that said first and second leg ends can be brought together whereby said first and second lower sections can be crossed, thereby creating an opening between said first and second elbows, an upper crossing locus wherein said first leg is in front of said second leg and a lower crossing locus wherein said second leg is in front of said first leg, edges of said opening being effective for gripping the garments substantially within said opening, said spring clip including a bias on said first and second legs when said legs are so crossed, urging facing surfaces of said first and second legs into engagement with each other, said first lower section of said first leg comprising a lock, said lower end being upturned, said lock comprising a hook formed between said up-turned lower end and an adjacent portion of said lower section of said first leg.

24. A spring clip as in claim 23, said hook comprising a first lock, and including, as a second lock, a lock slot in said first lower section of said first leg, for receiving said second lower section of said second leg, and locking said second lower section to said first lower section of said first leg.

25. A spring clip as in claim 24, said lock slot comprising at least a first undercut end, whereby, when said second leg is engaged in said lock slot, a first undercut surface on said first undercut end engages a second surface on said second leg.

26. A spring clip as in claim 25, said lock slot facing away from said second lower section of said second leg, when said spring clip is in a fully relaxed configuration.

27. A spring clip as in claim 24 and including a plurallity of second leg lock slots on said second lower section of said second leg, configured to cooperate with said first and asecond locks on said first leg.

28. A spring clip as in claim 24, said hook extending away from said second lower section of said second leg, when said spring clip is in a fully relaxed configuration.

29. A spring clip as in claim 27, and wherein, when said spring clip is in a fully relaxed configuration, said lock slot in said lower first section of said first leg faces away from said second lower section of said second leg and said at least one lock slot on said second lower section of said second leg faces away from said first lower section of said first leg.

30. A spring clip as in claim 23, said hook extending away from said second lower section of said second leg, when said spring clip is in a fully relaxed configuration.

31. A method of holding one or more garments in a spring clip garment holder while the garments are being processed, the material having resilient spring-like restorative properties such that the elongated material tolerates significant bending deformation without exceeding the corresponding elastic limit of the material, the length of elongated material comprising, when the spring clip is in the rest position, a bight, first and second legs extending from the bight, the first leg having a first upper section, the second leg having a second upper section, the first and second upper sections extending toward each other and terminating in corresponding first and second elbows, the first leg having a first lower section extending from the first elbow and terminating at a first end, the second leg having a second lower section extending from the second elbow and terminating at a second end, the first and second lower sections extending away from each other, and terminating at first and second leg ends, said first and second leg ends being configured such that said first and second leg ends can be brought together whereby said first and second lower sections can be crossed, thereby creating an opening between said first and second elbows, defined between an upper crossing locus wherein the first leg is in front of the second leg, and a lower crossing locus wherein the second leg is in front of the first leg, edges of the opening being effective for gripping the garment substantially within the opening between the upper and lower crossing loci, the spring clip including a bias on the first and second legs when the legs are so crossed, the bias urging facing surfaces of the first and second legs into engagement with each other at the upper and lower crossing loci, the first lower section of the first leg comprising a lock for locking the first leg to the second leg, the method comprising:

(a) bringing the first and sescond leg ends together such that one of the first and second ends can pass the corresponding other of the first and second legs, and whereby the first and second elbows move away from each other, creating an opening for receiving a garment thereinto;

(b) placing a garment in the opening above the lower crossing locus and below the upper crossing locus;

(c) passing the respective end in (a) past the corresponding other of the first and second legs such that the lower first and second sections of the legs are crossed, and thereby creating a bias urging facing surfaces of the first and second legs into engagement with each other at the upper and lower crossing loci;

(d) releasing the first and second legs while the first and second lower sections are crossed such that restorative forces in the legs urge the leg ends aaway from each other, and back toward their rest position but in the legs-crossed configuration, whereby the legs grip and hold the garment in the opening, and whereby the facing leg surfaces are urged toward each other at the upper and lower crossing loci; and (e) bringing the lock on the first leg into locking engagement with the second leg.

32. A method as in claim 31, said lock comprising a lock slot, for receiving and locking the first lower section of the first leg with the second lower section of the second leg, the lock slot comprising at least a first undercut end, and including engaging the second leg in the lock slot such that a first undercut surface on the undercut end engages a second surface on the second leg.

33. A method as in claim 31, the first leg having a lower end, said lock comprising a hook on the lower end of the first leg, and including engaging the second leg in the hook and thereby temporarily locking the second leg to the first leg.

34. A method as in claim 31, said lock comprising, as a first lock, a lock slot for receiving and locking the first lower section of the first leg with the second lower section of the second leg, said first leg having a lower end, and including, as a second lock, a hook on the lower end of the first leg, and including the step of aligning the lower section of the second leg with the hook in the first leg, such that the lower section of the second leg is simultaneously both locked into the lock slot and aligned with, and subject to being restrained by, the hook.

35. A method as in claim 31, said lock comprising, as a first lock, a first lock slot for receiving and locking the first lower section of the first leg with the second lower section of the second leg, and including at least one second lock slot on the second lower section of the second leg, the first and second lock slots facing away from each other, such that when the legs are crossed as in subparagraph (c), the first and second lock slots face toward each other, and including the step of bringing the first and second lock slots into locking engagement with each other.

36. A method as in claim 35, said first and second lock slots having first and second corresponding undercut ends, and including bringing the first and second lock slots into locking engagement with each other such that an outer surface on one of said first and second legs engages the corresponding undercut surface on the other of said first and second legs.

* * * * *